US005533538A

United States Patent [19]

Marshall

[11] Patent Number: 5,533,538

[45] Date of Patent: Jul. 9, 1996

[54] APPARATUS FOR CLEANING ARTICLES UTILIZING SUPERCRITICAL AND NEAR SUPERCRITICAL FLUIDS

[75] Inventor: Mary C. Marshall, San Antonio, Tex.

[73] Assignee: Southwest Research Institute, San Antonio, Tex.

[21] Appl. No.: 348,035

[22] Filed: Dec. 1, 1994

Related U.S. Application Data

[62] Division of Ser. No. 906,557, Jun. 30, 1992, Pat. No. 5,401,322.

[51] Int. Cl.[6] ..... B08B 3/10

[52] U.S. Cl. ..... 134/104.4; 134/105

[58] Field of Search ..... 134/105, 104.4, 134/107, 108

[56] References Cited

U.S. PATENT DOCUMENTS 1,771,698 7/1930 Wolff ..... 134/105 X 3,111,952 11/1963 Roehl ..... 134/105

4,322,252 3/1982 Plumb ..... 134/105 X

*Primary Examiner*—Philip R. Coe

*Attorney, Agent, or Firm*—Akin, Gump, Strauss, Hauer & Feld

[57] ABSTRACT

Disclosed is an apparatus and method of removing contaminants from an article utilizing a supercritical or near supercritical fluid. The article to be cleaned is first contacted with a fluid in which the contaminant is soluble at a first supercritical or near temperature. The contaminate solubilized fluid is then cooled or heated to a second supercritical or near supercritical temperature to lower the solubility of the contaminant in the supercritical fluid and thereby precipitate the contaminant. The contaminant is then recovered.

11 Claims, 2 Drawing Sheets

APPARATUS FOR CLEANING ARTICLES UTILIZING SUPERCRITICAL AND NEAR SUPERCRITICAL FLUIDS

This is a divisional application of application Ser. No. 07/906,557 filed Jun. 30, 1992 now U.S. Pat. No. 5,401,322, issued Mar. 28, 1995.

BACKGROUND OF THE INVENTION

1. Field of the Invention

The present invention relates to an apparatus for carrying out a method of cleaning articles utilizing supercritical or near supercritical fluids and differences in solubility of the contaminant in the supercritical fluid at various temperatures. In another aspect, the present invention relates to an apparatus for carrying out a method of cleaning articles utilizing supercritical or near supercritical fluids and differences in the density of the supercritical fluid at various temperatures to utilize convective flow in the cleaning process.

2. Description of the Related Art

It has long been known to use solvents in removing organic and inorganic contaminants from articles. In such processes, the contaminated article to be cleaned is contacted with the solvent. The contaminate is then solubilized by the solvent. Subsequent volatilization of the solvent separates the solvent and the contaminate. The vapors are then condensed and recontacted with the article to further clean it.

For example, U.S. Pat. No. 1,875,937, issued Sep. 6, 1932, to Savage, discloses that grease may be removed from the surface of metal castings and other nonabsorbent bodies by means of solvents.

One of the drawbacks of this type of cleaning process is that the cooling surfaces also have a tendency to condense water out of the atmosphere in addition to cooling and condensing the solvent. This condensed water then becomes associated with the solvent and thus comes into contact with the metal parts of the cleaning apparatus and with the material being treated.

U.S. Pat. No. 2,123,439, issued Jul. 12, 1938, to Savage, discloses that this problem of condensing water with the solvent may be overcome by first contacting the atmosphere with condensing surfaces at a temperature above the dew point of the atmosphere in which the operation is being carried out, but substantially below the condensing temperature of the solvent. The condensed solvent is utilized in the cleaning process. The uncondensed vapors are then brought into contact with cooler surfaces to condense out the water which is removed.

In addition to condensing the solvent on a cold surface and then contacting the condensed solvent with the article to be cleaned, it is also known to cool the article to be cleaned. For example, U.S. Pat. No. 3,663,293, issued May 16, 1972, to Surprenant et al., discloses that the degreasing of metal parts may be accomplished by generating vapors of a solvent from a liquid sump, establishing a vapor level by providing condensing means at the desired level, introducing the soiled cold part into the vapors, thereby causing the vapor to condense on the part. The condensate containing the soil falls from the parts into the sump. The part is taken from the vapor zone when its surface reaches the solvent vapor temperature.

In an effort to improve on the vapor degreasing methods, supercritical fluids have been utilized to clean contaminants from articles.

NASA Tech Briefs MFS-29611 (December 1990), discloses the use of supercritical $CO_2$ as an alternative for hydrocarbon solvents that are conventionally utilized for washing organic and inorganic contaminants from the surface of metal parts and machining fines. The typical supercritical cleaning process involves contacting a supercritical fluid with the part to be cleaned. The supercritical fluid into which the contaminant has been solubilized is then expanded to subcritical conditions to remove the contaminant. The cleaned fluid is then compressed back to supercritical conditions and contacted with the part to be cleaned. This cycle is continued until the part is cleaned.

U.S. Pat. No. 4,944,837, issued Jul. 31, 1990 to Nishikawa et al., discloses a method of cleaning a silicon wafer in a supercritical atmosphere of carbon dioxide. In the '837 patent, the supercritical carbon dioxide is first contacted with the silicon wafer to solubilize the contaminant. The fluid is then cooled to below its supercritical temperature.

Unfortunately, with the known processes of cleaning with supercritical fluids, the contaminants are removed with the fluid in a subcritical state. This means that energy must be expended cycling the cleaning fluid between the supercritical and subcritical state.

In addition, some of the prior art methods utilize forced flow of the supercritical fluid past the part to be cleaned to increase the effective cleaning efficiency. However, this forced flow adds cost in terms of energy requirements and sometime is detrimental when channeling occurs.

Therefore, there exists a need for a supercritical cleaning process in which the contaminants can be removed from the fluid while it is in the supercritical state. There also exists a need for a supercritical cleaning process not requiring forced flow of the fluid.

SUMMARY OF THE INVENTION

According to one embodiment of the present invention there is provided a process for removing a contaminant from an article. First, the article to be cleaned is contacted with a supercritical fluid in which the contaminant is soluble to solubilize the contaminant at a first supercritical temperature. Next, at substantially constant pressure, the solubility of the fluid with respect to the contaminant is reduced. For pressure regions where the solubility decreases with increasing temperature, the fluid is heated. For pressure regions where the solubility decreases with decreasing temperature, the fluid is cooled. Once the contaminant solubilized fluid has been cooled or heated to a second supercritical temperature to reduce the solubility of the contaminant in the fluid and precipitate at least a portion of the solubilized contaminant, the precipitated contaminant is recovered.

According to another embodiment of the present invention there is provided a process for removing a contaminant from an article. This process utilizes fluids which at the operating pressure have increasing contaminant solubility with decreasing temperature. In this process, the article is first contacted with a supercritical or near supercritical fluid in which the contaminant is soluble. Next, conventive flow of the fluid past the article is created between a heating and cooling zone. This is accomplished by cooling in the cooling zone, a portion of the fluid to increase the solubility of the contaminant in the cooled fluid and to increase the density of the fluid such that the density change will cause the cooled fluid to flow past the article, solubilize contaminant on the article, and further flow toward the heating zone. In the heating zone, a portion of the contaminant solubilized fluid is heated to decrease the solubility of the contaminant in the heated fluid to precipitate any excess contaminant in the heated fluid and to decrease the density of the heated fluid to cause it to flow toward the cooling zone. Finally, the precipitated contaminant is removed from the fluid.

According to yet another embodiment of the present invention there is provided a process for removing a contaminant from an article. Unlike the previous embodiment which utilized fluids having increasing contaminant solubility with decreasing temperature, this embodiment utilizes fluids, which at the operating pressure have increasing contaminant solubility with increasing temperature. In this process, the article is first contacted with a supercritical or near supercritical fluid in which the contaminant is soluble. Next, convective flow of the fluid past the article is created between a heating and cooling zone. This is accomplished by heating in the heating zone, a portion of the fluid to increase the solubility of the contaminant in the heated fluid and to decrease the density of the fluid such that the density change will cause the heated fluid to flow past the article, solubilize contaminant on the article, and further flow toward the cooling zone. In the cooling zone, a portion of the contaminant solubilized fluid is cooled to decrease the solubility of the contaminant in the cooled fluid to precipitate any excess contaminant in the cooled fluid and to increase the density of the cooled fluid to cause it to flow toward the heating zone. Finally, the precipitated contaminant is removed from the fluid.

According to still yet another embodiment of the present invention there is provided apparatus for carrying out the above methods. Such apparatus generally includes a pressure vessel having heating and cooling means for heating and cooling the fluid. Such apparatus also includes means for supporting the part to be cleaned in the supercritical fluid, and may even include means to rotate the part in the fluid to maximize the exposure of the part surface to the various fluid flow patterns.

DETAILED DESCRIPTION OF THE INVENTION

Figure 1:
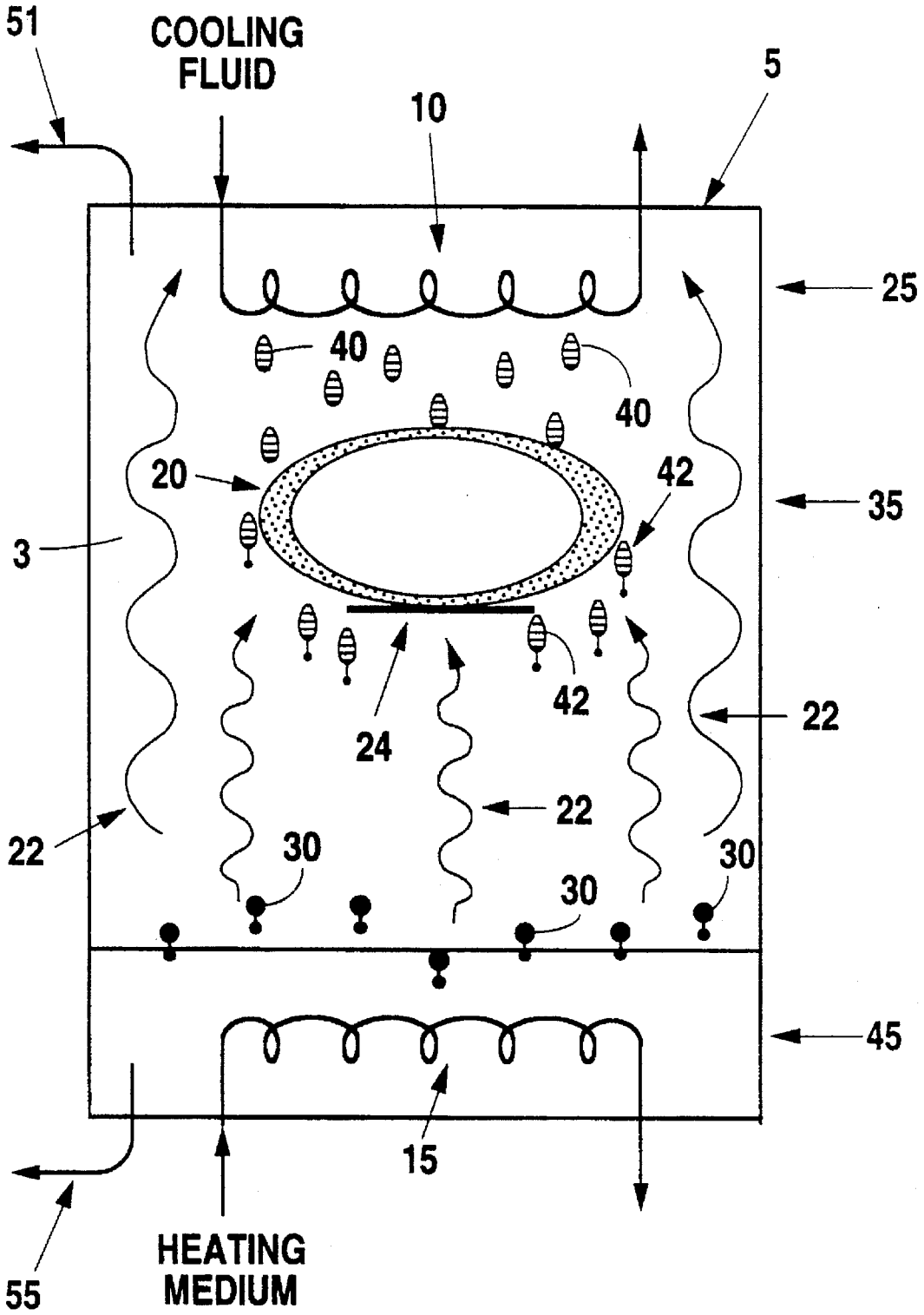
FIG. 1 shows one embodiment of the present invention with cooling means above the cleaned part and heating means below the cleaned part.

In the present invention, the article to be cleaned of contaminants is first contacted with a supercritical or near supercritical fluid in which the contaminant is soluble. The contacting occurs with the fluid at a first supercritical or near supercritical temperature. Near supercritical temperatures are generally greater than a reduced temperature of about 0.7, preferably greater than about 0.8 and most preferably greater than about 0.9. Once at least a portion of the contaminant is solubilized, the contaminate solubilized fluid is then cooled or heated to a second supercritical or near supercritical temperature to reduce the solubility of the contaminant in the supercritical fluid and precipitate at least a portion of the solubilized contaminant. The precipitate is then removed either batchwise or continuously.

"Precipitate" as used herein refers to the amount of contaminant above the solubility limit of the fluid that precipitates in a gas, liquid or solid form, from the fluid as its solubility is lowered.

The first and second supercritical or near supercritical temperatures may generally be any two supercritical or near supercritical temperatures as long as the solubility of the liquid is lower at the second temperature. Preferably, these temperatures will be selected to facilitate the solubilization of the contaminants at the first supercritical or near supercritical temperature and the precipitation of the contaminants at the second supercritical or near supercritical temperature. In addition, it is generally preferred that the second temperature be selected to minimize precipitation of the contaminant on the part as it removed at the end of the cleaning process. This usually means that a low solubility of the contaminant at the second temperature is desired. Preferably, the first and second temperatures will be supercritical with respect to the fluid utilized.

The present invention is generally operated at a substantially constant pressure, that is selected along with the temperature to provide the proper differences in solubilization between the first and second supercritical temperatures.

The supercritical or near supercritical fluid utilized in the present invention is generally selected for its ability to solubitize the contaminant to be removed. Near supercritical fluids generally have reduced temperature and pressure values greater than about 0.7, preferably greater than about 0.8 and most preferably greater than about 0.9. Suitable supercritical or near supercritical fluids include inert gases, hydrocarbons, fluorocarbons and carbon dioxide. Preferably, the supercritical or near supercritical fluid utilized is selected from the group consisting of carbon dioxide and $C_1$ to $C_{10}$ hydrocarbons. Most preferably, the fluid is utilized is a supercritical fluid. The cleaning ability of the fluid may be enhanced by the addition of at least one selected from the group consisting of cosolvents, entrainers and surfactants.

Once the cleaning process is completed, the part must be removed from the vessel in a manner that minimizes precipitation of contaminant on the part. Generally this may be accomplished by precipitating contaminant on a heat transfer device while depressurizing or by varing the rate of depressurizing. In addition, when processing pressure sensitive parts or electronic components, it is generally necessary to control both pressurizing and depressurizing to avoid damage to these parts or components.

EXAMPLES

The following are theoretical examples provided to further illustrate various embodiments of the present invention. Table 1 shows the solubility of naphthalene in supercritical ethylene.

TABLE 1

Solubility of Napthalene in Supercritical Ethylene

| | Solubility (g/L) | | Approximate Reduced Density ($P_r$) | |
|---|---|---|---|---|
| Reduced Temperature: Reduced Pressure | 1.10 | 1.12 | 1.01 | 1.12 |
| 1.2 | 7.1 | 0.24 | 1.4 | 0.4 |

TABLE 1-continued

| Solubility of Napthalene in Supercritical Ethylene | | | | |
|---|---|---|---|---|
| | Solubility (g/L) | | Approximate Reduced Density ($P_r$) | |
| 2.0 | 14 | 14 | 1.8 | 1.1 |
| 6.1 | 22 | 150 | 2.1 | 1.9 |

Example 1

The apparatus of this example is shown in FIG. 1 in which pressure vessel 5 comprises heating means 15 and cooling means 10. In the present embodiment, heating means 15 and cooling means 10 are shown as coils, but it is understood that any suitable heat transfer means may be utilized such as flat plates, trays or any other known heat transfer device. In vessel 5 there is the cooling zone 25, cleaning zone 35 and heating zone 45. Naphthalene contaminated part 20 is supported in cleaning zone 35 by support 24 which is generally a metal screen. Support 24 may optionally be connected to a rotating means to enhance the exposure of part 20 to the various fluid flows. In the embodiment shown supercritical fluid 3 is ethylene.

In operation, the system is operated at 60.6 atm (reduced pressure of 1.2) with the cooling zone at 13° C. and the cleaning zone at a temperature between 13° C. and 44° C. At those temperatures, ethylene has a density of 0.305 g/cc and 0.087 g/cc, respectively. Consequently, as heating means 15 heats the supercritical ethylene in the heating zone to 44° C., it forms a less dense supercritical ethylene which rises toward the cooling zone as shown by arrows 22. Cooling means 10 cools the supercritical ethylene which increases its density to 0.305 g/cc and at the same time increases its solubility with respect to naphthalene to 7.1 g naphthalene/liter ethylene. The more dense supercritical ethylene now flows down as indicated by drops 40 to contact part 20 and solubilize some of the contaminant naphthalene. As the naphthalene solubilized supercritical ethylene 42 is heated up, its solubility with respect to naphthalene decreases to 0.24 g naphthalene/liter ethylene, thereby precipitating excess naphthalene 30. The precipitated naphthalene is far more dense than the fluid 3 and falls to the bottom of vessel 5. The naphthalene may be periodically or continuously removed from vessel 5 via contaminant purge means 55. For some contaminants or fluids it may be necessary to utilize a separation means, such as for example, a separatory funnel to force settling of the contaminant in the bottom of vessel 5 or a demister. In the event that contaminants less dense than the supercritical fluid are precipitated, they may be periodically or continuously removed via purge means 51.

While the present invention is mainly directed to removing contaminants that are soluble in the supercritical or near supercritical fluid, the convection action generated may also loosen insolubles which will be removed via purge means 51 or 55 depending on their density.

Example 2

Figure 2:
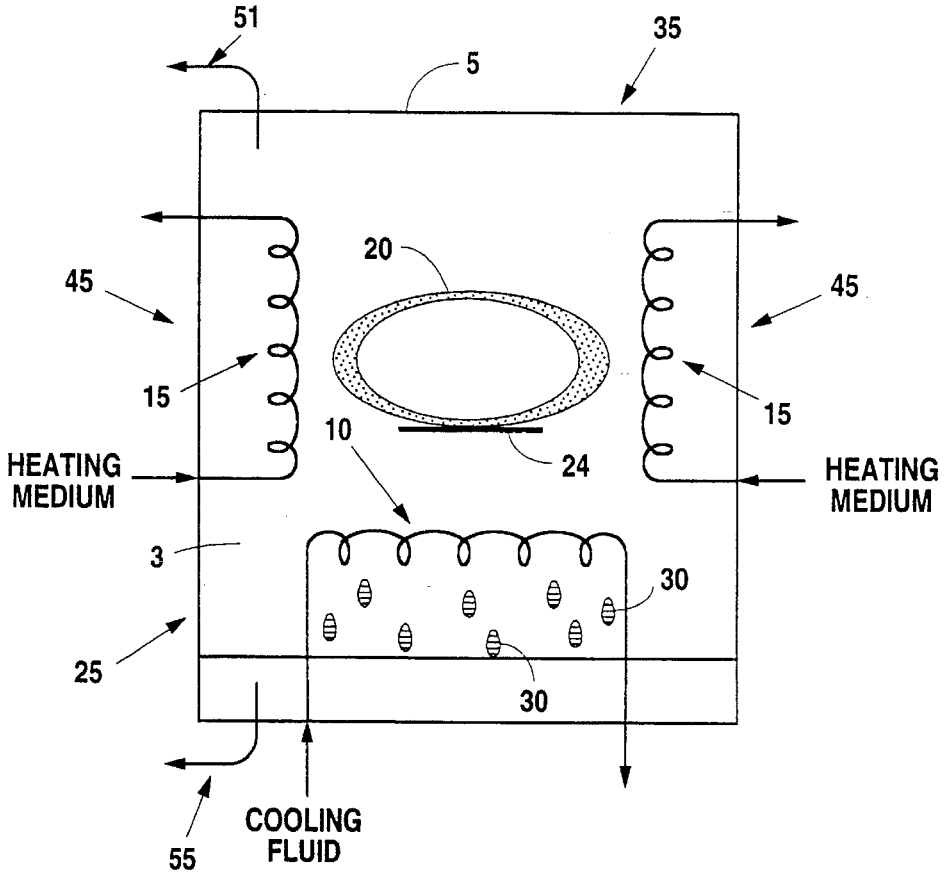
FIG. 2 shows another embodiment of the present invention with cooling means below the cleaned part and heating means positions around the part.

The apparatus of this example is shown in FIG. 2 wherein the reference numbers are the same as in FIG. 1. In this example, the system is operated at a pressure of 308.05 atm (reduced pressure of 6.1). Generally for supercritical fluids, at higher pressures, the solubility increases with increasing temperature. Since solubilities are generally much greater at the higher pressures, such higher pressures could be utilized for a gross cleaning setup and then a lower pressure such as shown in FIG. 1 could be utilized for final polishing.

Since the denser cooler supercritical ethylene (0.458 g/cc) is below the hotter lighter supercritical ethylene (0.414 g/cc), the vigorous convection illustrated in FIG. 1 will be absent. Optionally, this arrangement may be operated by maintaing the pressure substantially constant through the use of the heating means and convection generated by cycling the cooling means on and off. The contaminants would be removed during the cooling cycle. At this pressure, the solubility of naphthalene in ethylene in the 44° C. hot zone and the 13° C. cool zone is 150 g naphthalene/liter ethylene and 22 g naphthalene/liter ethylene, respectively.

Example 3

Figure 3:
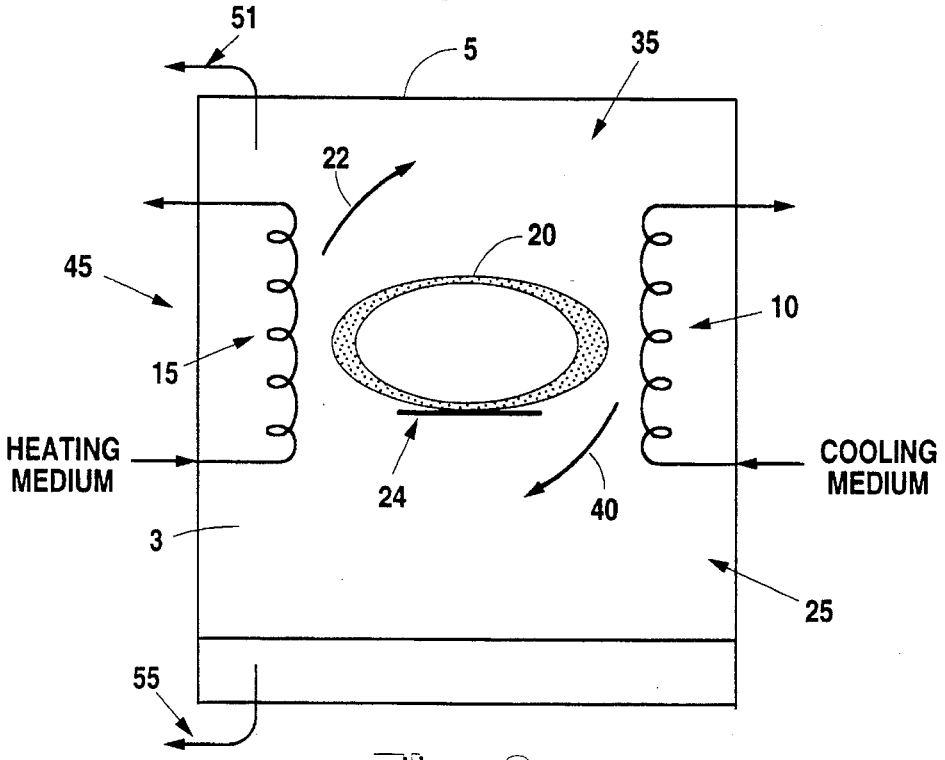
FIG. 3 shows another embodiment of the present invention with cooling means to one side of the cleaned part and heating means positioned on the other side of the cleaned part.

The apparatus of this example is shown in FIG. 3 wherein the reference numbers are the same as in FIG. 1. As can been seen in this example, the convective flows 22 and 40 will create a clockwise pattern around part 20, instead of flowing up and down as in FIG. 1 (of course, a counter clockwise pattern may be created by reversing the positions of heating means 15 and cooling means 10). When operating in the pressure regions where the solubility increases with increasing temperature it is desirable to position part 20 near or in stream 22. When operating in the pressure regions where the solubility decreases with increasing temperature it is desirable to position part 20 near or in stream 40. This example is at a reduced pressure of 6.1. In this example, heating means 15 heats the fluid causing it to rise as shown by arrow 22. The ethylene fluid is heated to 44° C. which as shown in Table 1 has a density of 0.414 g/cc and a solubility of 150 g naphthalene/liter ethylene. This heated fluid has the ability to readily solubilize naphthalene as it passes part 20. The naphthalene solubilized ethylene then reaches cooling means where it is cooled to 13° C., which as shown in Table 1 has a density of 0.458 g/cc and a solubility of 22 naphthalene/liter ethylene. This cooling will cause precipitation of naphthalene in excess of the 22 g/l value. The naphthalene, having a density of 1.179 g/cc at 13° C. will fall to the bottom of vessel 5. The cooled ethylene that passes around to heating means 15 to continue the cycle.

With the clockwise or counter clockwise pattern it may be necessary to utilize baffles or screens to encourage precipitation and to direct the precipitate away from part 20 and toward purge means 51 or 55.

I claim:

1. An apparatus for removing contaminants from an article with a supercritical fluid, comprising:

(a) a pressure vessel having a cooling zone, heating zone and a cleaning zone;

(b) a support means positioned in the cleaning zone for supporting the article to be cleaned;

(c) a heating means positioned to heat the supercritical fluid in the heating zone to cause it to flow by convection through the cleaning zone and into the cooling zone;

(d) a cooling means positioned to cool the supercritical fluid in the cooling zone to cause it to flow by convection through the cleaning zone and into the heating zone; and (e) recovery means positioned to recover contaminants.

2. The apparatus of claim 1 wherein said cooling means is positioned above said heating means.

3. The apparatus of claim 1 wherein said cooling means is positioned below said heating means.

4. The apparatus of claim 1 wherein said cooling means and said heating means are positioned about even with said support means.

5. The apparatus of claim 1 additionally comprising a supercritical fluid within said pressure vessel.

6. The apparatus of claim 5 additionally comprising a near supercritical fluid within said pressure vessel.

7. The apparatus of claim 1 wherein said recovery means is positioned below said support means.

8. The apparatus of claim 1 wherein said recovery means is positioned above said support means.

9. The apparatus of claim 1 additionally comprising an article to be cleaned.

10. The apparatus of claim 9 wherein heating and cooling elements are arranged to provide a substantially upward flow of solubilizing fluid over the article to be cleaned.

11. The apparatus of claim 9 wherein heating and cooling elements are arranged to provide a substantially downward flow of solubilizing fluid over the article to be cleaned.

* * * * *